US006941863B2

(12) United States Patent
Iwamoto

(10) Patent No.: US 6,941,863 B2
(45) Date of Patent: Sep. 13, 2005

(54) PLATE TRANSFER APPARATUS

(75) Inventor: Masayuki Iwamoto, Shizuoka (JP)

(73) Assignee: Shinohara Machinery Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/719,733

(22) Filed: Nov. 21, 2003

(65) Prior Publication Data

US 2005/0109228 A1 May 26, 2005

(51) Int. Cl.[7] ..... B65H 5/04; B41F 21/00
(52) U.S. Cl. ..... 101/477; 271/225
(58) Field of Search ..... 101/477, 401.1, 101/382.1; 271/3.01, 3.03, 225, 275, 902

(56) References Cited

U.S. PATENT DOCUMENTS 6,792,861 B2 * 9/2004 Kan et al. ..... 101/477
2003/0183107 A1 * 10/2003 Kan et al. ..... 101/477

FOREIGN PATENT DOCUMENTS

| | | |
|---|---|---|
| JP | 8-108525 | 4/1996 |
| JP | 2941598 | 6/1999 |
| JP | 11-254645 | 9/1999 |

* cited by examiner

*Primary Examiner*—Leslie J. Evanisko
(74) *Attorney, Agent, or Firm*—Ladas & Parry

(57) ABSTRACT

Plate transfer apparatus is disclosed which is suitable for satellite-type printing press and excels in operability with small space.

For these purposes, plate transfer apparatus comprises transfer means (26) which has functions in it's normal and opposite rotations, for ejecting the used plate (52) outwards and feeding new plate (50) to the plate cylinder (16), flat sustaining board (30) provided above the transfer means (26) in order to prepare new plate (30), one end of the board (30) is swingably supported and the other end is branched, and drive means (36) for swinging the sustaining board (30) in order to sink the branched end into transfer path of the transfer means (26).

3 Claims, 8 Drawing Sheets

PLATE TRANSFER APPARATUS

BACKGROUND OF THE INVENTION

1. Field of the Invention

The present invention relates generally to sheet-fed printing press, or more precisely, to plate transfer apparatus by which the used plate around the plate cylinder is ejected and new plate to be used is transferred to the cylinder.

2. Description of the Prior Art

In sheet-fed press by offset printing technique, ink and dampening water are supplied to the plate wound around the plate cylinder to form pictures which are then printed on the sheet by way of blanket cylinder.

In work switching of pictures to be printed, the used plate must be promptly ejected and also new plate to be used must be transferred efficiently to the plate cylinder. These are premises for automatic plate exchange.

In Japanese published unexamined patent specification No. 108525/1996, new plate casing is swingably provided in narrow space between printing units and new plate is transferred to the plate cylinder by plate exchange apparatus with complicated attitude control device and plate feeder.

Also in Japanese published unexamined patent specification No. 254645/1999, apparatus is disclosed which comprises plate passage with bent portion near the plate cylinder, sucker for transferring the plate and various check means for strictly checking plate transfer.

In Japanese patent specification No. 2941598, apparatus is disclosed with thin board which is swingable around an axis and the plate is guided by the this board.

The apparatus with swingable casing occupies broad space and its construction is extremely complicated. Also the apparatus with sucker and strict check device costs high in production due to its complicated structure. Moreover the apparatus with turning axis obligates precise maneuvering and lacks swiftness in operation.

Nowadays, printing order has a tendency of so-called many sorts with small lot, consequently work exchange, namely plate exchange, is frequent. Thereafter, the apparatus for plate exchange shall be convenient in handling and be excellent in operation. In addition, the apparatus shall be small in its occupation and be easy in its process control, in consideration of adapting the apparatus not only to conventional series-type press, but also to satellite-type printing press in which printing units are provided in satellite-like manner around the common pressure cylinder. Moreover, high production cost hinders the apparatus from coming into use in printing press.

SUMMARY OF THE INVENTION

In view of the above-described problems of the prior art techniques, the present invention provides an improved plate transfer apparatus and aims at raising operativity in plate exchange process. The other objects are to reduce the occupied space and to facilitate the control of exchange process, so as to adapt the apparatus to satellite-type printing press. Further object is to simplify the construction, so as to lower the cost.

In accordance with the present invention, plate transfer apparatus comprises; transfer means which has functions, in its normal and opposite rotations, for ejecting the used plate outwards and feeding new plate to cylinder; flat sustaining board provided above the transfer means in order to prepare new plate, one end of the board is swingably supported and the other end is branched and; drive means for turning the sustaining board in order to sink the branched end into the transfer path of the transfer means.

The branched portion of the sustaining board is divided into comb-like shape. In addition, stopper for preventing reversion of the used plate as well as detecting means for detecting passage of the used plate on the stopper are provided on the way of ejection path of transfer means.

In ejection, the used plate is led from plate cylinder onto transfer means and, with normal rotation of transfer means, is ejected outwards after passing over the stopper and detecting means.

In feeding, sustaining board is turned by drive means and the branched portion sinks into the transfer path of transfer means.

Thereby, new plate prepared on the sustaining board goes onto the plate cylinder with opposite rotation of transfer means.

These and other objects of the invention will become apparent from the following description with reference to the drawings. But, these show merely an embodiment of the invention.

BRIEF DESCRIPTION OF THE DRAWINGS

FIG. 3 shows preparation of new plate and release of the used plate at its rear end.

DESCRIPTION OF PREFERRED EMBODIMENT

Figure 1:
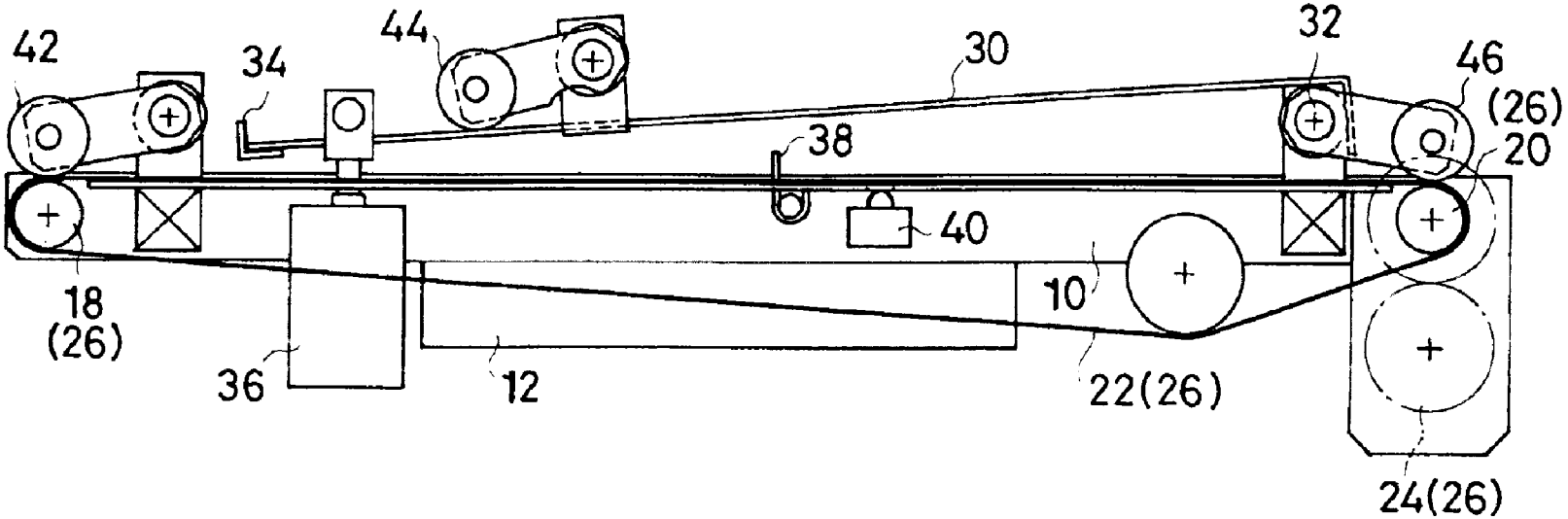
FIG. 1 is a side section showing an embodiment of plate transfer apparatus according to the present invention.

Base (10) is a flat structure which composes the structural base of the apparatus and is combined to side frames (14) of printing press by way of proper bracket (12). From the front end (Plate cylinder (16) side) to the rear end (Right side of figures. Operator side) of the base (10), an endless belt (22) is stretched by a pair of conveyor rollers (18), (20). The endless belt (22) is rotated both in normal (clockwise) and opposite (anti-clockwise) directions by a motor (24) which drives the rear conveyor roller (20) in order to eject or feed the printing plate. Therefore, these endless belt (22), conveyor rollers (18), (20) and motor (24) compose transfer means (26) of printing plate.

Figure 2:
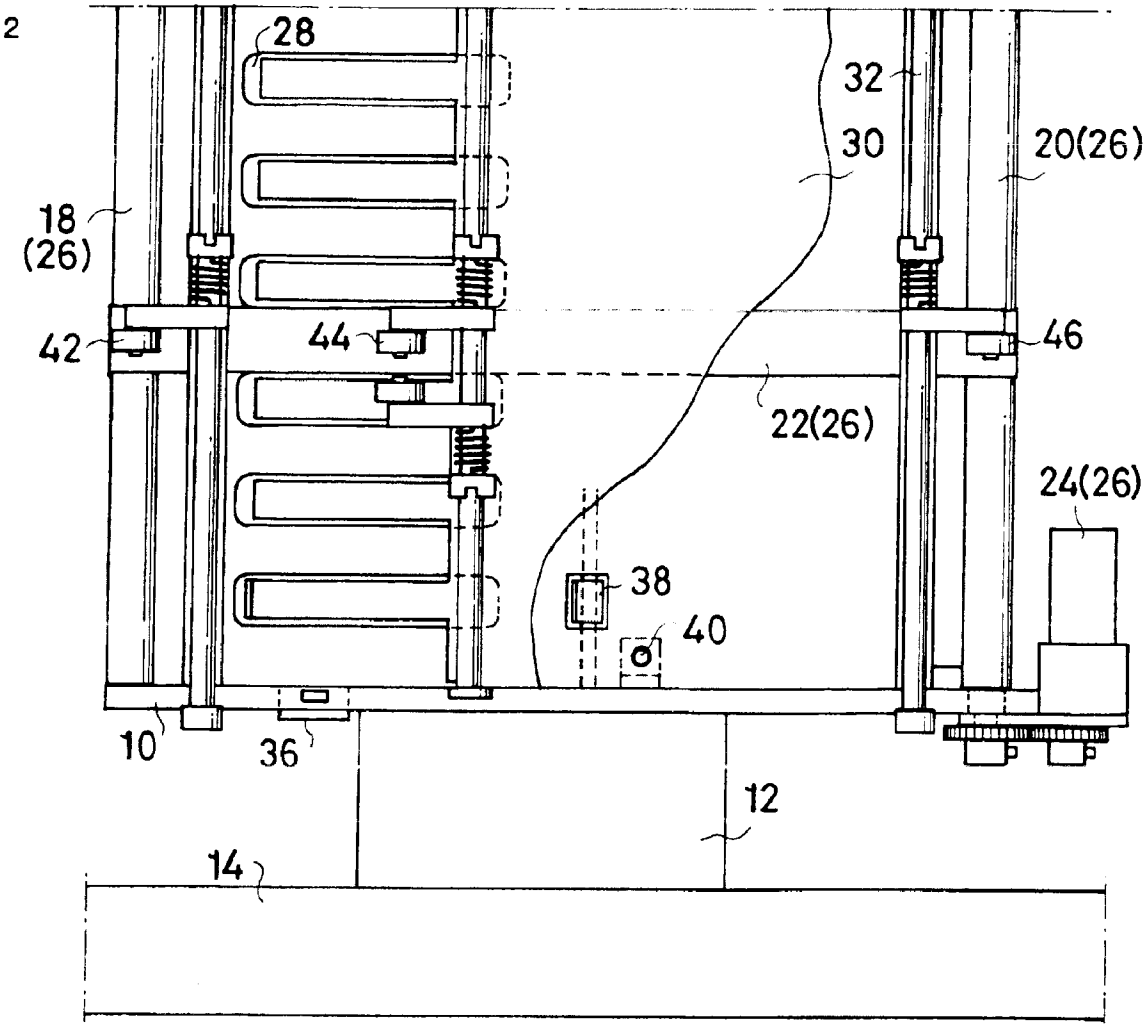
FIG. 2 is a plan view showing left half of the apparatus.

As shown in FIG. 2, a plurality of oblong holes (28) are provided in a row at the plate cylinder (16) side of base (10) and these holes (28) are dented from the surface of base (10). Above the transfer means (26), sustaining board (30) is provided on which new plate to be used is prepared. The sustaining board (30) is a plane member whose rear end is swingably combined to the axis (32) and has placement projections (34) of printing plate at fronted and side ends.

Drive means (36) such as air cylinder is connected to the front end of sustaining board (30). (Not to mention, drive means (36) itself is combined to base (10).) Drive means

(36) works on and turns on sustaining board (30) around the axis (32), thereby the branched front end of sustaining board (30) sinks into oblong holes (28) of base (10).

On the way of plate ejection path of transfer means (26), spring-biased stopper (38) is provided which falls only in plate ejecting direction (From plate cylinder (16) side to operator side, in other words, right direction of figures.), so as only to allow ejection of the used plate and to prohibit reversing of the plate to the plate cylinder (16) direction. In order to detect passage of the used plate to be ejected on the stopper (38), detecting means (40) such as photo-electronic sensor is prepared near the stopper (38). Numerals (42), (44) and (46) indicate rollers to press on the plate.

Next, operation of above-said construction is described. As to the outline of plate cylinder (16), a pair of front end and rear end clamps are provided in a groove (48) which extends parallel to cylinder axis direction (Perpendicular to FIG. 3). Both front and rear ends of plate are stretched by these clamps so as to closely attach it around the cylinder (16). The clamping apparatus can be done or released from outside. Such techniques are well known in the art by Japanese published unexamined patent specification No. 286111/1994 or so.

Figure 3:
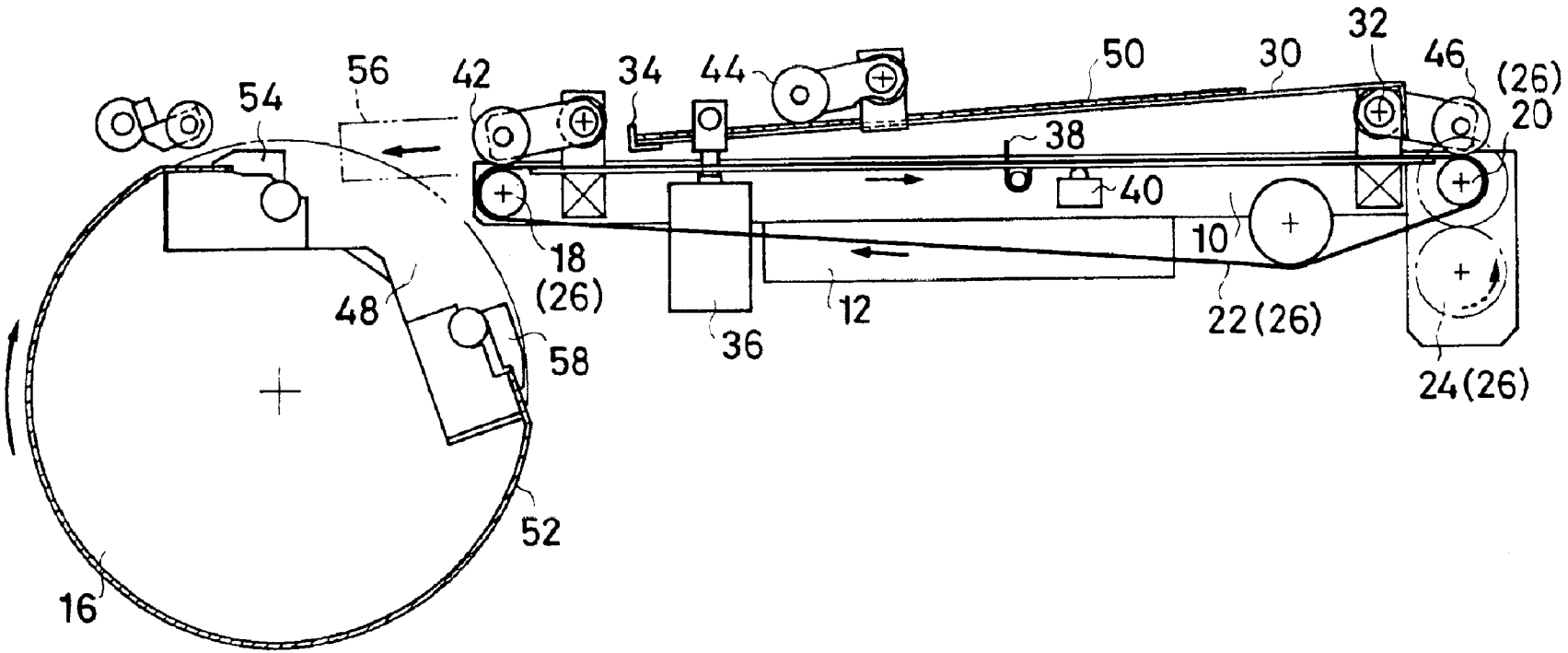
FIG. 3 and under are explanatory views showing operations in order.

In FIG. 3, new plate (50) to be used is prepared on the sustaining board (30) and, on the other hand, rear end of the used plate (52) is set free, as the plate cylinder (16) is rotated up to an appropriate degree and rear clamp (54) is released by actuator (56).

Figure 4:
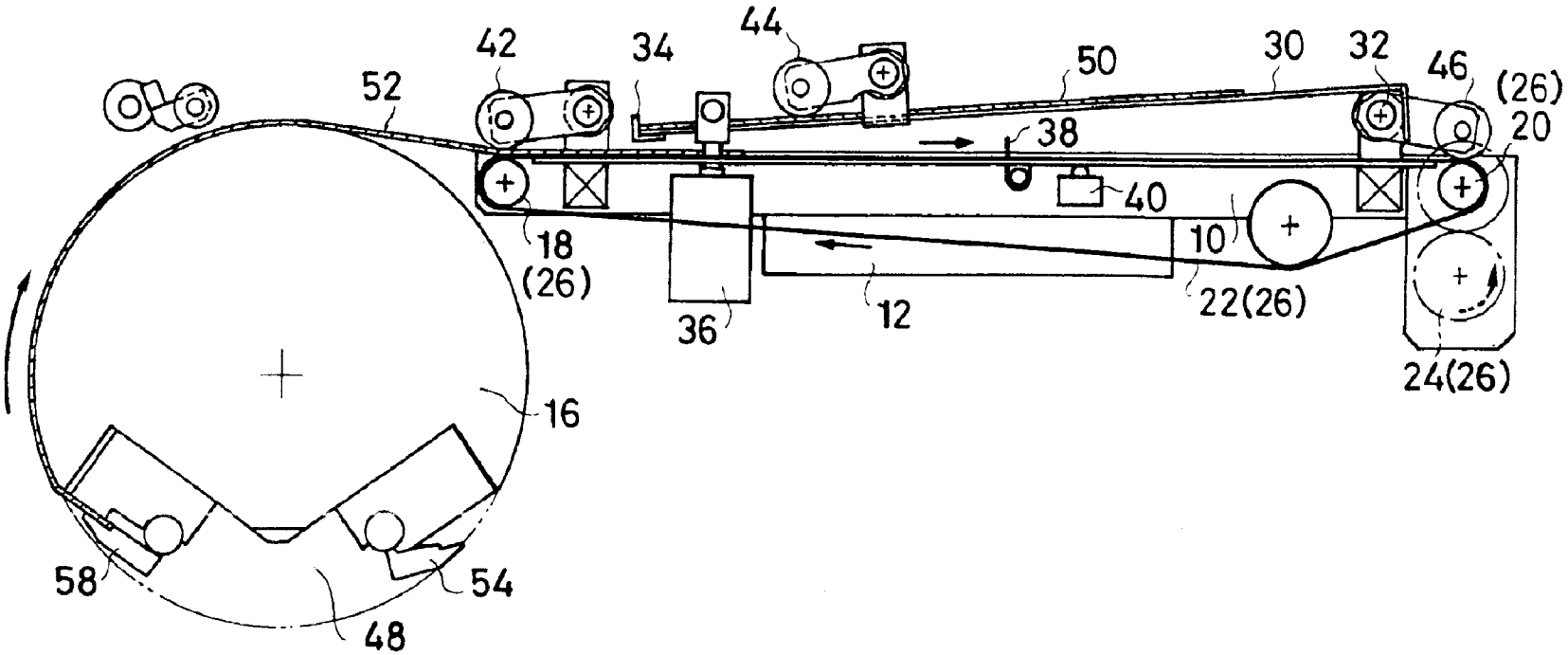
FIG. 4 shows beginning of ejection by transfer means.

Rear end of the unclamped plate (52) is, as shown in FIG. 4, led onto the transfer means (26) and plate ejection process begins with normal rotation (clockwise rotation) of transfer means (26). On the moment, also the plate cylinder (16) is rotated in normal direction and transfer roller (42) presses the used plate (52) onto the endless belt (22).

Figure 5:
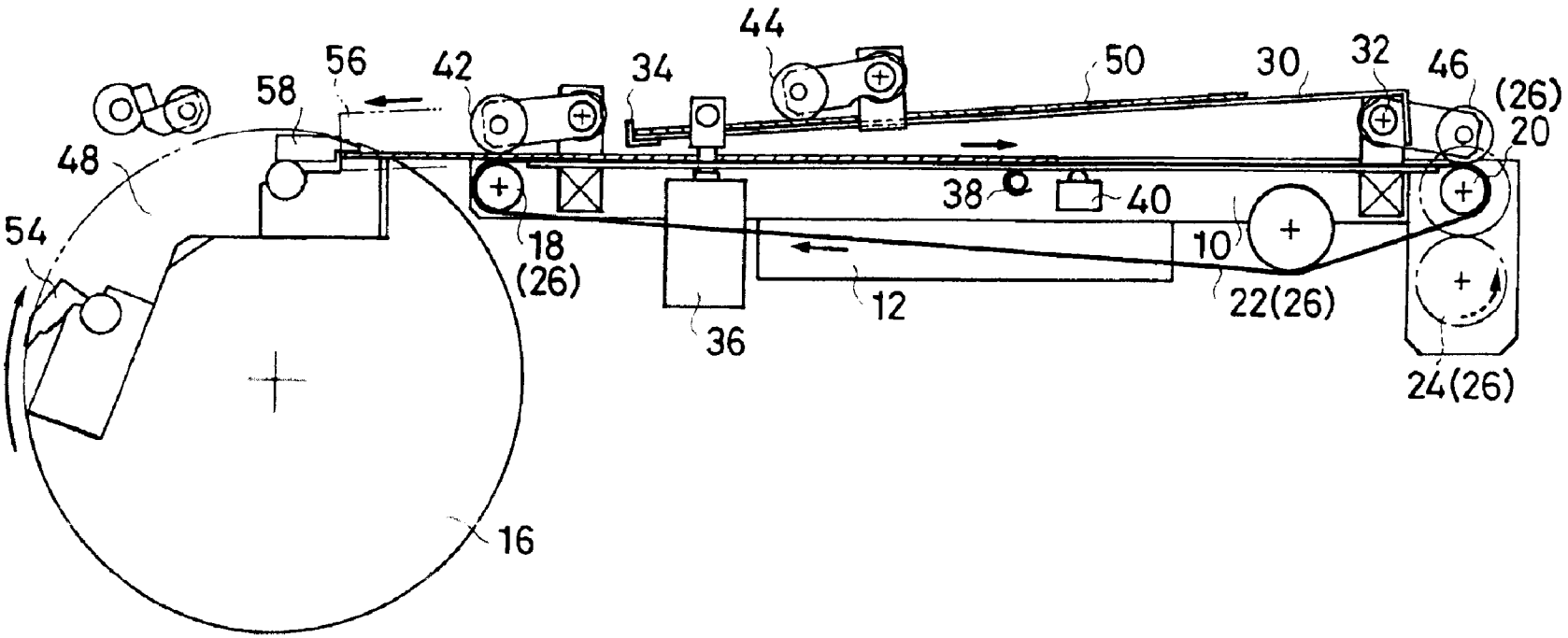
FIG. 5 shows release of the used plate at its front end.

As shown in FIG. 5, used plate (52) goes on with normal rotation of transfer means (26) and begins overriding the spring-biased stopper (38) on the way of transfer path. Then the used plate (52) is completely set free from plate cylinder (16), as front clamp (58) is released by an actuator (56).

Figure 6:
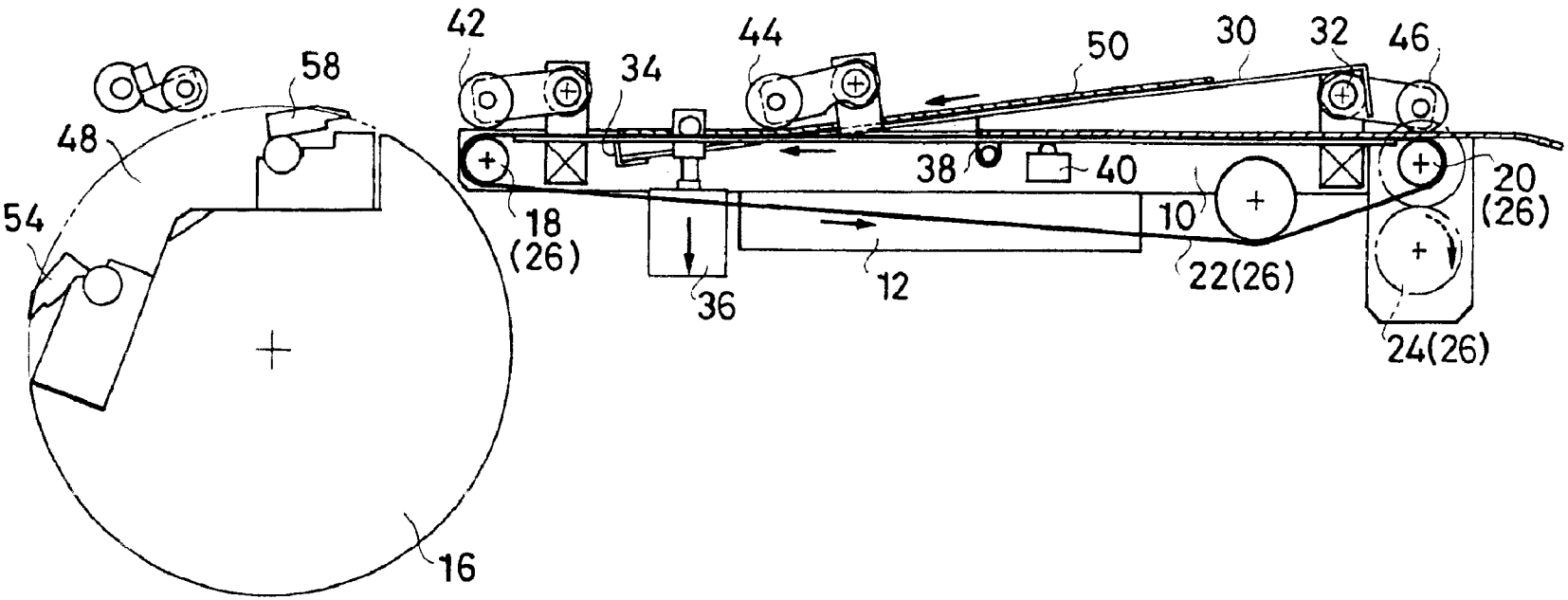
FIG. 6 shows a state in which feeding of new plate begins, on the other hand, reversing of the used plate is prohibited.

FIG. 6 is decidedly important to the invention. When tail end (which was before front end) of the used plate (52) passes over the stopper (38), it stands up again to prohibit reversing of the used plate (52) anymore. Thereafter, detecting means (40) detects passage of the used plate (52) on the stopper (38) and drive means (36) works on the sustaining board (30) to turn it around the axis (32). Thereby, the comb-like branched portion of sustaining board (30) sinks into oblong holes (28). At this moment, opposite rotation (Anti-clockwise in FIG. 6) of transfer means (26) begins. Although reversing of the used plate (52) is hindered by the stopper (38), new plate (50) goes on toward the plate cylinder (16) by endless belt (22). In other words, new plate (50) marches on the opposite direction of ejection path of the used plate (52), also utilizing the same path.

Figure 7:
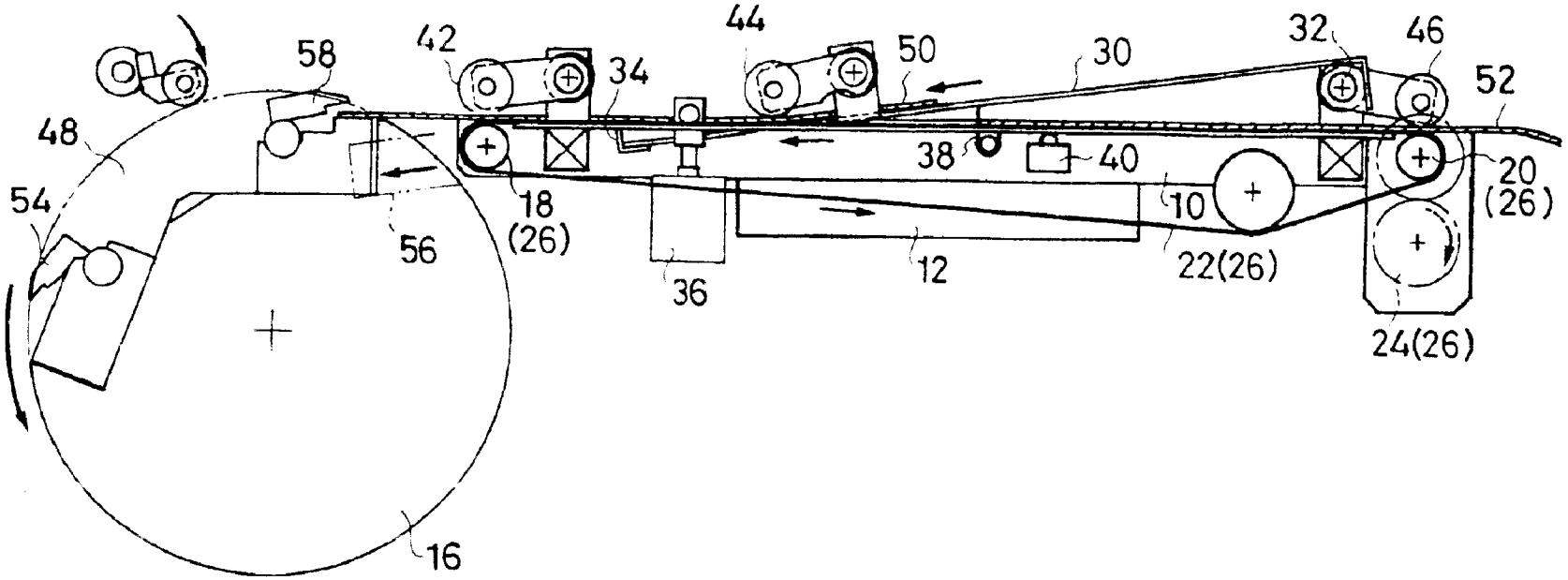
FIG. 7 shows a state in which front end of new plate is clamped.

Front end of new plate (50) is, as shown in FIG. 7, clamped by front clamp (58) and new plate (50) is attached around the cylinder (16) with anti-clockwise rotation of it.

Figure 8:
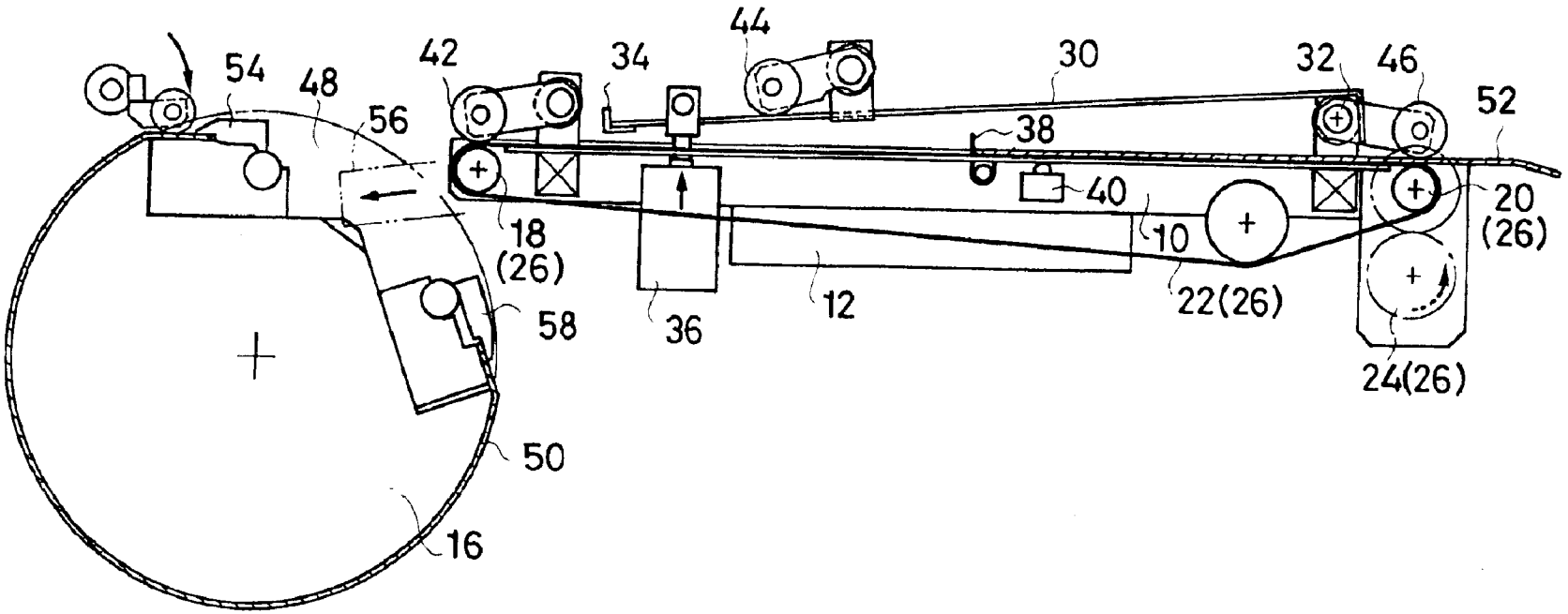
FIG. 8 shows a state in which new plate is completely attached and sustaining board is restored.

Finally as shown in FIG. 8, rear end of plate is clamped by rear clamp (54) to complete the attachment of new plate (50). Drive means (36) restores to raise the sustaining plate (30) and the used plate (52) is removed by operator.

In plate transfer apparatus according to the present invention, the apparatus itself is fixed. Transfer means rotates both in normal and opposite directions in order to eject as well as feed the plate. New plate is led to the transfer path of transfer means by the turning of sustaining board.

Thereby, plate exchange can be carried out rapidly and precisely without particular skill. In addition, the apparatus costs low and can be adapted to satellite-type printing press.

The present invention is not limited to the embodiment described hitherto. Various changes and modifications can, of course, be made without departing from the spirit of the invention.

What is claimed is:

1. Plate transfer apparatus comprising:

transfer means (26) for ejecting a used plate (52) outwards from and feeding a new plate (50) to a plate cylinder (16) by respectively rotating the transfer means in normal and opposite rotational directions, a flat sustaining board (30) provided above said transfer means (26) in order to prepare a new plate (50), one end of said board (30) is swingably supported and the other end is branched, and drive means (36) for swinging said sustaining board (30) in order to sink said branched end into a transfer path of said transfer means (26).

2. Plate transfer apparatus according to claim 1, wherein said branched portion of said sustaining board (30) is divided into a comb-like shape.

3. Plate transfer apparatus according to claim 2, wherein a stopper (38) for preventing reversion of the used plate (52) as well as detecting means (40) for detecting passage of the used plate (52) on said stopper (38) are provided on the way of an ejection path of said transfer means (26).

* * * * *